US009359725B2

(12) United States Patent
Singh et al.

(10) Patent No.: US 9,359,725 B2
(45) Date of Patent: Jun. 7, 2016

(54) STEPWISE REPEATED DESTABILIZATION AND STABILIZATION OF HIGHLY COLLAPSIBLE SOIL MASS BY 'SOIL NAILING TECHNIQUE' USED FOR CONSTRUCTION OF RAILWAY/ROAD UNDERPASS

(71) Applicant: Council of Scientific & Industrial Research, New Delhi (IN)

(72) Inventors: Kanwar Singh, New Delhi (IN); Pulikanti Subramanya Prasad, New Delhi (IN); Sudhir Mathur, New Delhi (IN); Farhat Azad, New Delhi (IN); Subhamay Gangopadhyay, New Delhi (IN)

(73) Assignee: COUNCIL OF SCIENTIFIC & INDUSTRIAL RESEARCH, New Delhi (IN)

( * ) Notice: Subject to any disclaimer, the term of this patent is extended or adjusted under 35 U.S.C. 154(b) by 0 days.

(21) Appl. No.: 14/415,553

(22) PCT Filed: Jul. 17, 2013

(86) PCT No.: PCT/IN2013/000442

§ 371 (c)(1),
(2) Date: Jan. 16, 2015

(87) PCT Pub. No.: WO2014/013508

PCT Pub. Date: Jan. 23, 2014

(65) Prior Publication Data

US 2015/0197895 A1 Jul. 16, 2015

(30) Foreign Application Priority Data

Jul. 17, 2012 (IN) ..... 136/2012

(51) Int. Cl.
*E01C 1/04* (2006.01)
*E02D 3/12* (2006.01)

(Continued)

(52) U.S. Cl.
CPC ... *E01C 1/04* (2013.01); *E02D 3/12* (2013.01); *E02D 7/06* (2013.01); *E02D 17/20* (2013.01);

(Continued)

(58) Field of Classification Search
CPC ..... E01C 1/04; E02D 17/20; E02D 3/12; E02D 31/08; E02D 7/06; E21D 21/0026; E21D 23/03; E21D 23/24
See application file for complete search history.

(56) References Cited

U.S. PATENT DOCUMENTS 958,952 A * 5/1910 Bennett ..... A01C 5/06 111/190
2,074,003 A * 3/1937 Templeton ..... E21B 7/046 175/53

(Continued)

*Primary Examiner* — Benjamin Fiorello
(74) *Attorney, Agent, or Firm* — Knobbe, Martens Olson & Bear, LLP

(57) ABSTRACT

The excavations of side vertical walls for building and underpasses must be shored so that the excavations adjacent to the neighboring properties do not cave in during the constructions. A Soil Nailing system has been used for stabilization of excavations and natural slopes for the last few decades in India and Abroad. Soil Nailing Technique used steel anchor rods inserted directly into the soil mass as a driven nails and when Nails are placed in pre-drilled holes to form grouted nails. In both the cases, it restrained load and the side deformations. In the present study, an innovative technique of 'Soil Nailing' has been developed for stepwise vertical de-stabilization and stabilization of compacted collapsible sandy soil for the construction of railway underpasses in live railway loading conditions. This technique is successfully implemented first time in the world for controlled destabilization of vertical cut slope and again stabilization for creating a space for pushing of box for railway underpasses for the length of 22 m and 50 m at two sites, namely Yamuna Bazzar and Apsara border, respectively, in Delhi, India. This Soil Nailing Technique of controlled destabilization of soil and again stabilization in steps has proved a superficial method of stabilization with the other methods for such kind of dynamic loading situations.

7 Claims, 7 Drawing Sheets

Figure 1:
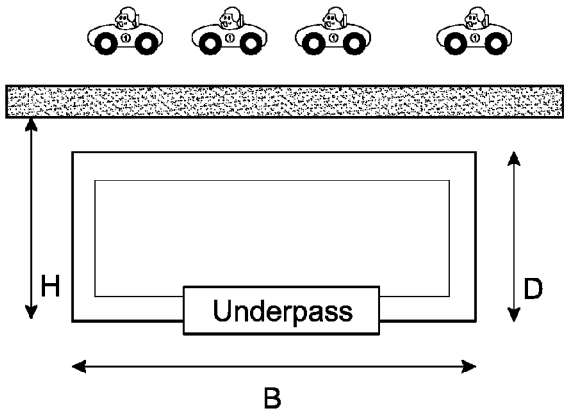

(51) Int. Cl.

| | |
|---|---|
| ***E21D 21/00*** | (2006.01) |
| ***E02D 7/06*** | (2006.01) |
| ***E02D 31/08*** | (2006.01) |
| ***E21D 23/03*** | (2006.01) |
| ***E21D 23/24*** | (2006.01) |
| ***E02D 17/20*** | (2006.01) |

(52) U.S. Cl.
CPC ..... *E02D 31/08* (2013.01); *E21D 21/0026* (2013.01); *E21D 23/03* (2013.01); *E21D 23/24* (2013.01)

(56) References Cited

U.S. PATENT DOCUMENTS 3,968,655 A * 7/1976 McGlothlin ..... E21D 20/021 405/138
4,009,579 A * 3/1977 Patzner ..... E21D 9/005 175/62
4,139,320 A * 2/1979 Ueno ..... E21D 9/005 405/132
4,166,509 A * 9/1979 Ueno ..... E21D 9/005 173/196
4,388,020 A * 6/1983 Uemura ..... E21D 9/005 405/138
4,405,260 A 9/1983 Tsai et al.
4,459,064 A * 7/1984 Berset ..... E02D 5/18 405/138
5,240,352 A * 8/1993 Ilomaki ..... E21B 7/205 175/62
6,375,390 B1 * 4/2002 Lunardi ..... E21D 9/1053 405/134

* cited by examiner

STEPWISE REPEATED DESTABILIZATION AND STABILIZATION OF HIGHLY COLLAPSIBLE SOIL MASS BY 'SOIL NAILING TECHNIQUE' USED FOR CONSTRUCTION OF RAILWAY/ROAD UNDERPASS

FIELD OF THE INVENTION

Present invention relates to the method of repeated destabilisation and stabilisation of vertical cut slope of highly collapsible sandy soil by 'Soil Nailing Technique' for the construction of underpass below the rail/road traffic through tunneling process. The underpass is constructed below the railway track where 250 to 300 trains passing over a day which required uninterrupted railway track having zero mistake zone in Delhi.

BACKGROUND OF THE INVENTION

Rapid growth in population, industries, infrastructure development in the urban area tremendously increased the traffic volume which resulted the traffic congestion on the roads led to shortage of road space at ground level, therefore, there is need to create extra space above or below the ground level to meet out this demand. Construction of elevated roads/railways disturb the traffic system, however, the underground structures like multilevel roads or underpasses, road tunnels, metro systems do not disturb the surrounding. In this regards the other scopes of underground structures like; Malls, multilevel basements, water supply, flood water storage tunnels, sewers, cable tunnels, substations, air raid shelters, and storage facilities, etc tremendously increased in the city. To meet out the current traffic and other demands, civil engineers have been using valuable underground space beneath the urban areas. All these underground structures involve huge construction cost time and manpower not only this, these structures also required special construction skill. Moreover, all these structures associated with foundations. Therefore, the stability of these structures is at most important. The stability of these structure is mainly depends upon the foundation soil and vertical stability of side walls. In nature soil is generally exist in heterogeneous state, it is not necessary that all the time soil condition may suit the structural requirements. The inadequate stability of slope can be improved by suitable ground improvement techniques. There are many methods available for ground improvement. Soil Nailing Technique has proved a safe and economical solution (10% to 30%) if we compare with the other method of stabilisations.

In general, the requirement of shallow depth tunnel is more because of usability, availability of land and project costs. It has been analysed and found that stability of shallow depth tunnel are very less as compared to deep tunnels. The shallow depth tunnels have been constructed using cut and cover techniques, which have often proved highly disruptive requiring road closures and property demolition. At shallow depth the natural arching properties of ground do not develop. With the advancement of civil engineering in globe, the pre-cast technology had proved a time and cost saving technique for the construction of civil engineering projects. In-pre cast technology, the project is usually constructed in steps followed part to the whole. Therefore, the scope of underground construction using pre-cast panel is gaining popularity. Therefore, our research emphasised on stepwise stabilisation of soil inside and outside of precast box to be pushed through the jacking technique into the existing soil masses.

References may be made to U.S. Pat. No. 4,009,579, wherein Delbert M. Patzner et. al provide a method for constructing tunnels and underpasses quickly and inexpensively, with conventional readily available equipment, without disrupting existing constructions and without interrupting or delaying service thereon. The method comprises the inserting a plurality of longitudinal support members side by side through the ground beneath the existing structure followed by excavating a longitudinal increment of the ground beneath the support members. Thereby, installing tunnel forming precast sections beneath the support members in place of each longitudinal increment of excavated ground to support which the support members, repeat the excavation and placement of tunnel forming section till the full length of tunnel is covered.

References may be made to patent U.S. Pat. No. 4,139,320 wherein, a process for excavating and constructing a tunnel with the help of an excavating device excavator equipped with a screw conveyor has been provided. This process is directed to excavating and constructing a tunnel under a railway or a road on a bank or on level land in the direction transverse to the railway or road. In this process, pits are dug on both sides (entrance and exit end). In this respect, a hollow casing unit of a box shape is coupled to the rear end of the excavator equipped with a screw conveyor. As the excavator advances or digs forward a given distance, another casing unit is in turn coupled to the rear end of the preceding casing unit, and then such a step is repeated, until the excavator goes out of the wall of another pit. The sand and soil inside the outer wall of the tunnel are excavated and removed, after which reinforcing steel bars and a mold are placed along the inner surface of the wall of the tunnel. Concrete is then poured into the hollow casing units themselves as well as between the mold and the wall. Thus, the hollow casing units form an integral part of the wall of a tunnel, as an outer wall.

References may be made to patent U.S. Pat. No. 4,405,260 wherein a method of constructing underpass across railway and highway without affecting normal traffic thereof, the steps of excavating a traction ditch on one side of the road foundation and a launching ditch on the other; building a traction wall with traction holes therein against the road foundation in the traction ditch; and sequentially tracing a precast box culvert one after another through perforating, anchoring and jack driving according to the construction line until a predetermined configuration is completed thereat. Subsequently, build pier foundations, supports, and a bridging beam; arrange shell pipes; place PC steel reinforcements; and, after a certain curing period, perform pre-stress operations in the precast box culverts of the structure and grout cement mortar therein. Finally, excavate the earth volume under the structure and finish the road surface of the underpass for opening to traffic.

The previous patents/intentioned revealed that, soil stabilisation part inside the tunnel boundary has not been covered by any of the investigators. All the above said methods used for generalized soil conditions. The present invention is fruitfully worked for all collapsible soil/generalized soil conditions and any kind of loading conditions. The stabilisation of soil using 'Soil Nailing Technique' will be viable solution for such kind of underpass constructions.

In this patent application, step wise stabilisation of soil slope inside and outside of the tunnel and construction of underpass is explained in a simplified way irrespective of soil type/conditions.

To carry out this task, detailed field and laboratory investigations were carried out and all the relevant data pertaining to the project was collected. Based on our previous experience of handling projects of underground construction and the problems of slope stability in hilly terrain in landslides prone areas, it was decided to adopt 'Soil Nailing Technique' for the stabilisation of vertical cut slope in sandy strata to facilitate the box pushing through sand, while maintaining the movement of train without any interruption.

Soil Nailing is a relatively new construction technique used in Europe and America but very little work in this regard is carried out in India. Soil nailing consists of reinforcing the soil mass by introducing a series of thin elements called Nails to resist tension, bending and shear stresses. The reinforcing elements are made of steel round bars called as Nails. Nails are installed sub-horizontally or horizontally into the soil mass in pre-bored holes, which are grouted along their full length to form "Grouted Nails" or simply driven into the ground, called as "Driven Nails". The nails or metallic reinforcement, which are installed horizontally into the soil mass improve the shear strength and resist bending and tensile stresses developed in soils under loading. This technique is generally recommended to stabilise cut slopes, which are cohesive in nature and under static overburden pressure. However, under this project, the technique is conceptualised for stabilising pure sandy soil of collapsible nature under heavy dynamic loading. The concept was initially tested in a small scale laboratory model studies. Based on the observations a design was developed for a large scale live project with heavy dynamic loads with the help of nails and supportive plates. The bending and shear stresses were checked at different locations in the entire soil mass to prevent failure due to shear and surface erosion.

Though it was quite difficult to replicate the field conditions in the model test, nevertheless, the model studies provided a great insight to understand the behaviour of mass movement of sandy soil under heavy and dynamic loads with and without soil nailing. On the basis of the model studies, strategy for design and construction methodology of the project was formulated. The technique helped in successfully pushing the three boxes and creating an underpass in a record period of time without any kind of problem and this has resulted to open the bye-pass road much before the commencement of the commonwealth games.

This technique was tried first time in the world for such a kind of project in zero tolerance zones.

OBJECTS OF THE INVENTION

Main object of the present invention is to provide de-stabilisation and stabilisation of vertical cut slope of highly collapsible soil mass by 'Soil Nailing Technique' used for construction of rail/road underpass beneath the rail/road traffic without disrupting the live condition of traffic. Another object of the present invention is to provide inexpensively and safely construction of underpass under highly loaded and zero tolerance where 250 to 300 trains passing over that track.

Yet another object of the present invention is to permit the safe construction of tunnel/underpass beneath continuously used rail road traffic without the use of alternate route of the rail track.

Yet another object of the present invention is to prevention of sudden collapse of sandy soil in dynamic loading conditions.

SUMMARY OF THE INVENTION

Accordingly, present invention provides a process for making underpass through railway track or road without service interruption in stepwise de-stabilisation and stabilisation of highly collapsible soil mass by soil nailing technique and the said process comprising the steps of:

i. marking position of the box on the face of the retaining wall or embankment;

ii. dismantling the retaining wall above the marked position of the box and providing temporary support by shuttering plates having holes for pre decided position of nails to be driven in the vertical face;

iii. nailing the soil mass by using grouted nails and optionally driven nail above the marked position of the box;

iv. again dismantling the retaining wall, placing the shuttering plates with pre drilled position of nails and inserting only the driven nails from top to bottom of box pushing area;

v. leaving complete nail system for period in the range of 8 to 12 hrs to mobilize the friction of the nails;

vi. bringing box close to the soil nailed wall face;

vii. loosening the one top row of shuttering plates, excavating the soil for 30 to 40 cm depth;

viii. repeating step (vii) till the entire rows of the nails are covered for 30 to 40 cm depth followed by pushing the box in excavated area of 30 to 40 cm depth;

ix. pushing the nails into the soil mass and again tightening of shuttering plates;

x. again repeating step (vii) to (ix) till 50% of the box pushing length;

xi. cutting the nails in the range of 25 to 35 cm to create the space for box pushing when the one first/pointed end of the nails will touch with other end of retaining wall followed by placing vertical nails in order to increase the stability of cut slope;

xii. again repeating step (vii) to (ix) till complete insertion of box for making underpass.

In an embodiment of the present invention, thickness of the shuttering plate used is in the range of 3 to 5 mm.

In another embodiment of the present invention, length of the grouted nail and driven nails in step (iii) is equal to the length of the underpass.

In yet another embodiment of the present invention, diameter of the grouted nail used is in the range of 90 to 110 mm.

In yet another embodiment of the present invention, diameter of the driven nail used is in the range of 25 to 32 mm.

In yet another embodiment of the present invention, length of the driven nail used in step (iv to xii) is optimised with height of the vertical cut height in 0.7H wherein H is the height of vertical cut slope.

In yet another embodiment of the present invention, it should be ensured that all the driven nails should be have an extra length of at least 40 cm outside the shuttering plate.

BRIEF INSCRIPTION OF THE DRAWINGS

Figure 2A:
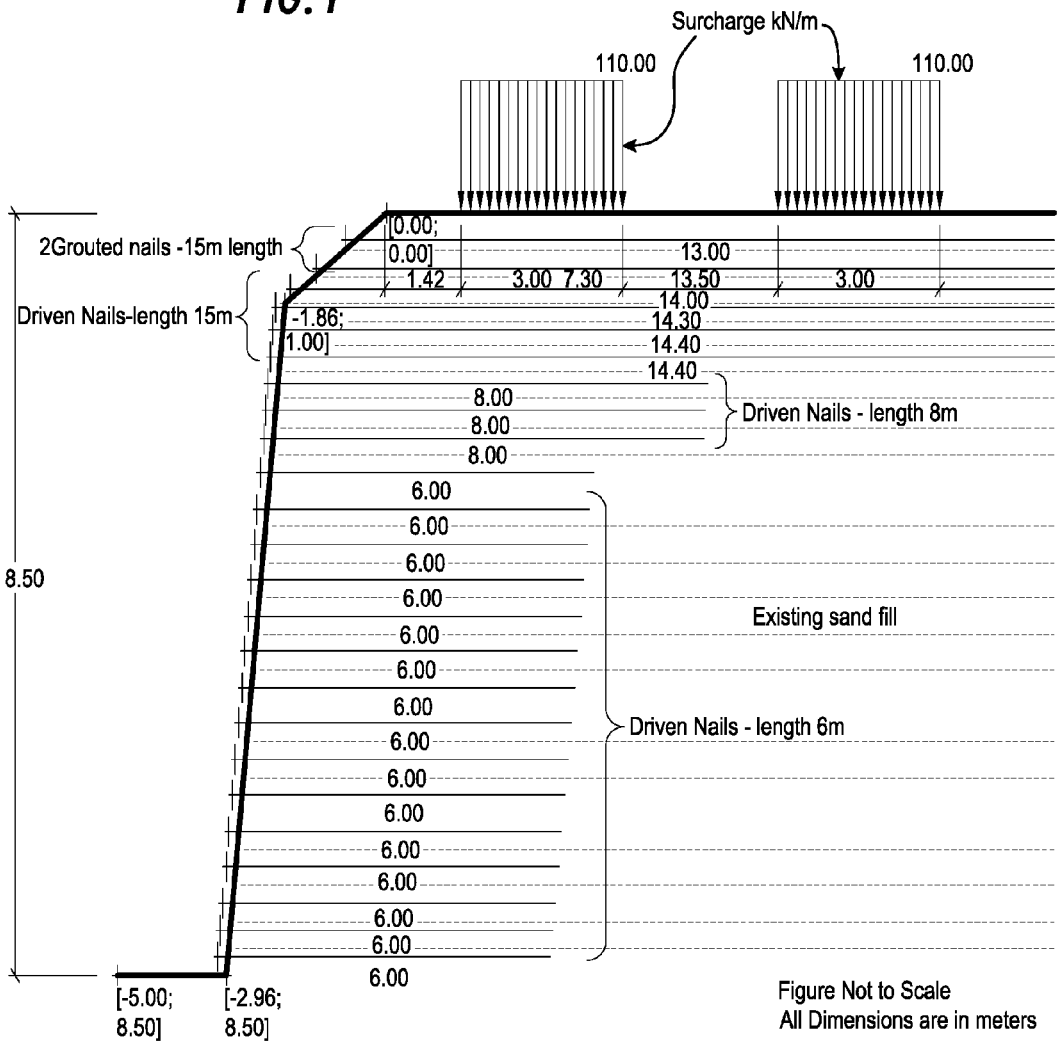
Figure 2B:
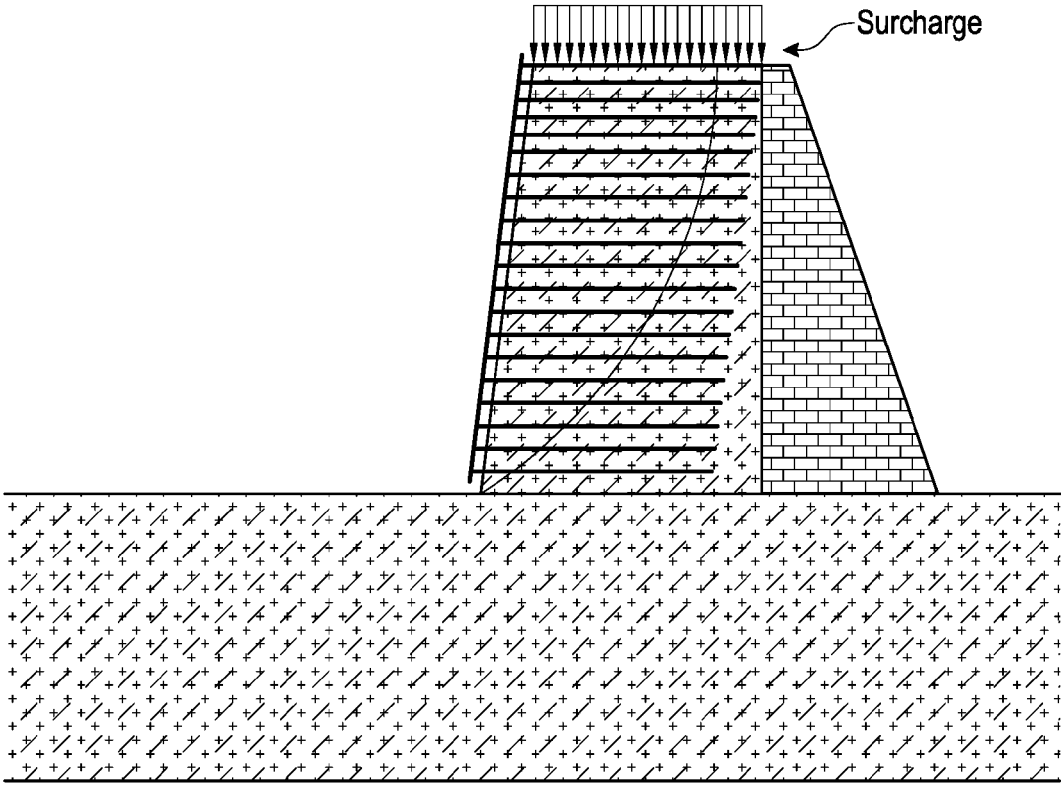
Figure 2C:
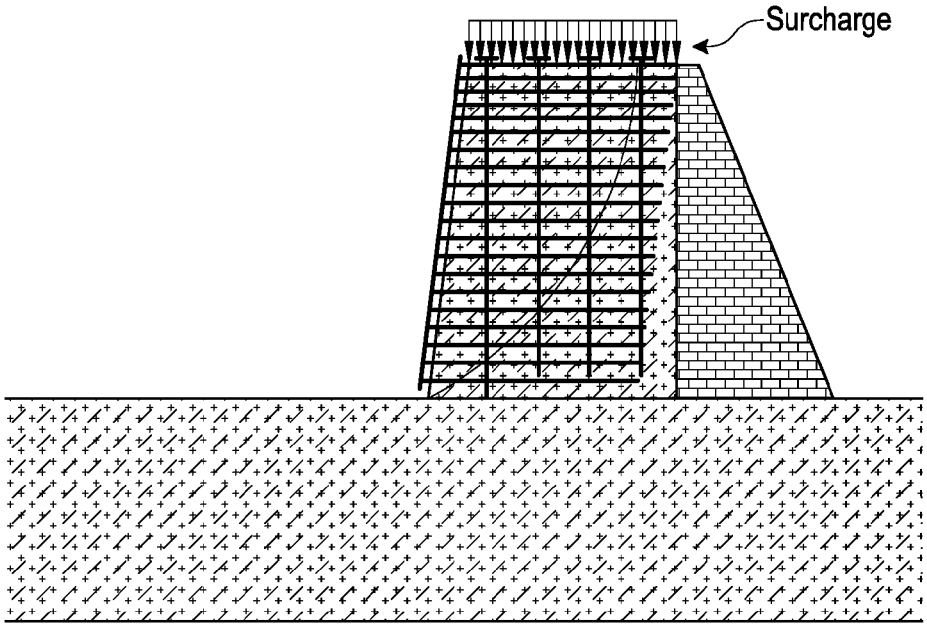
Figure 3A:
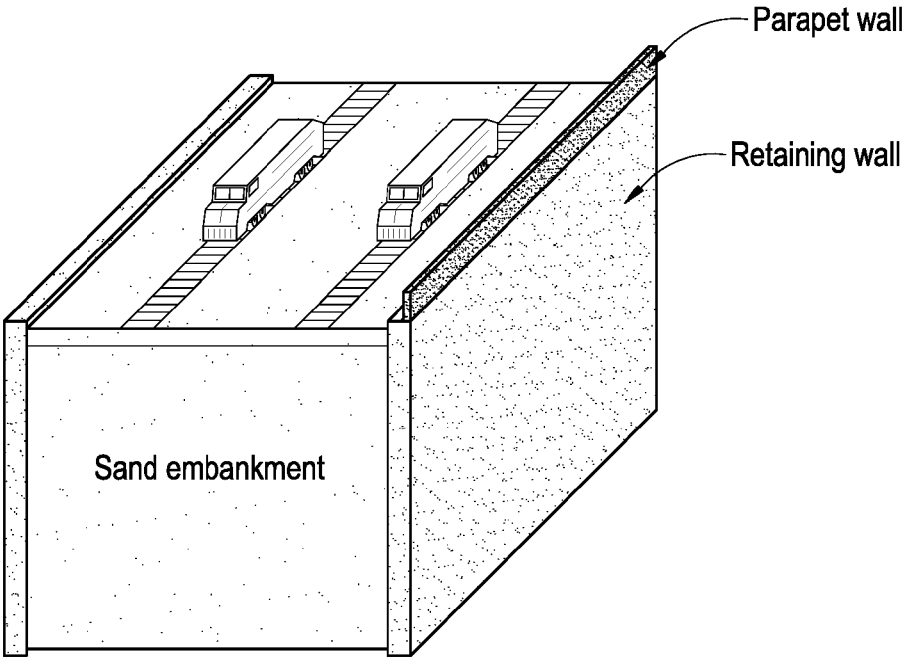
Figure 3B:
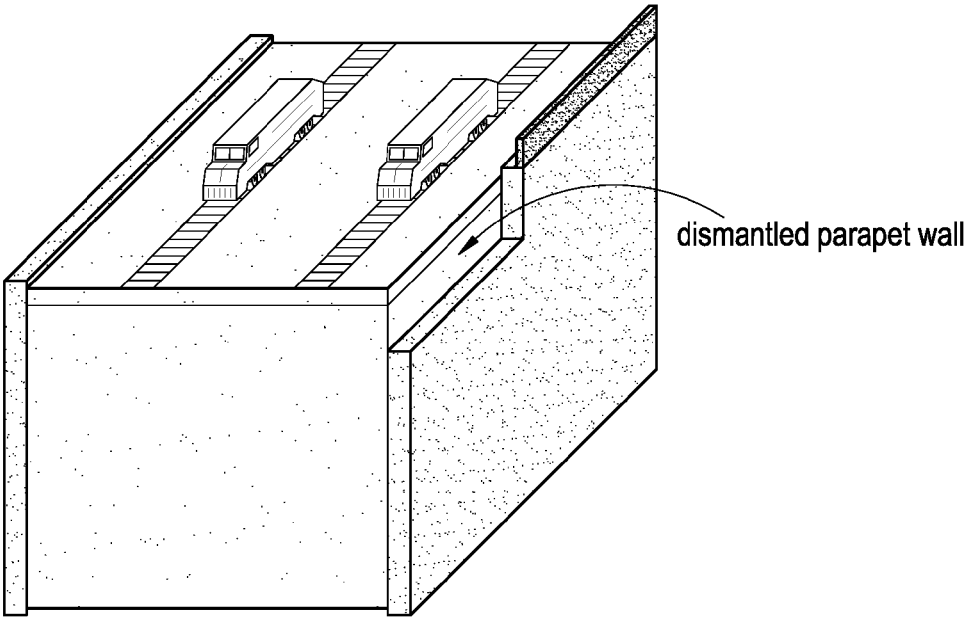
Figure 3C:
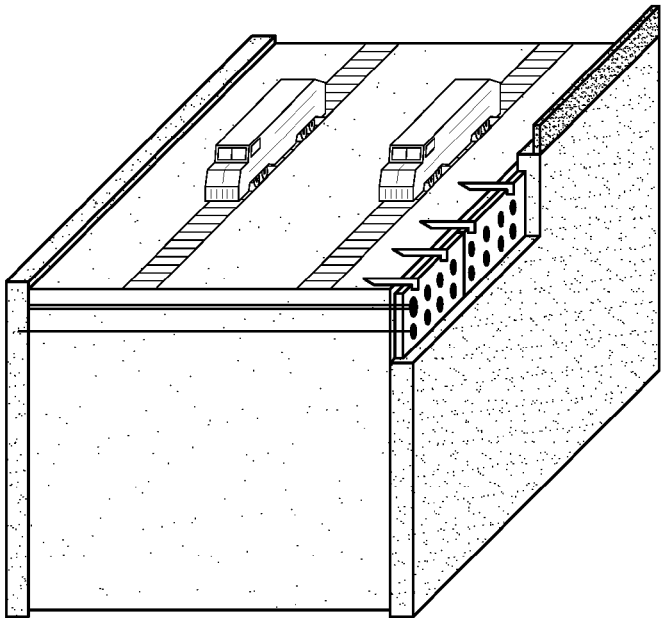
Figure 3D:
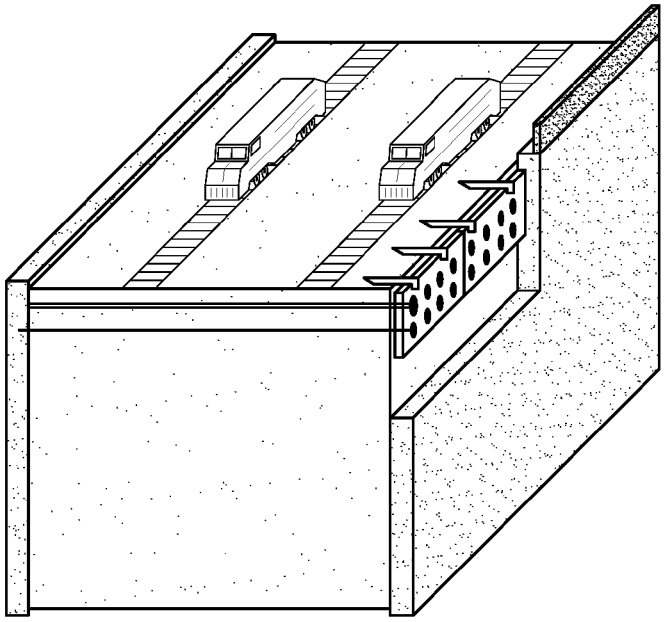
Figure 3E:
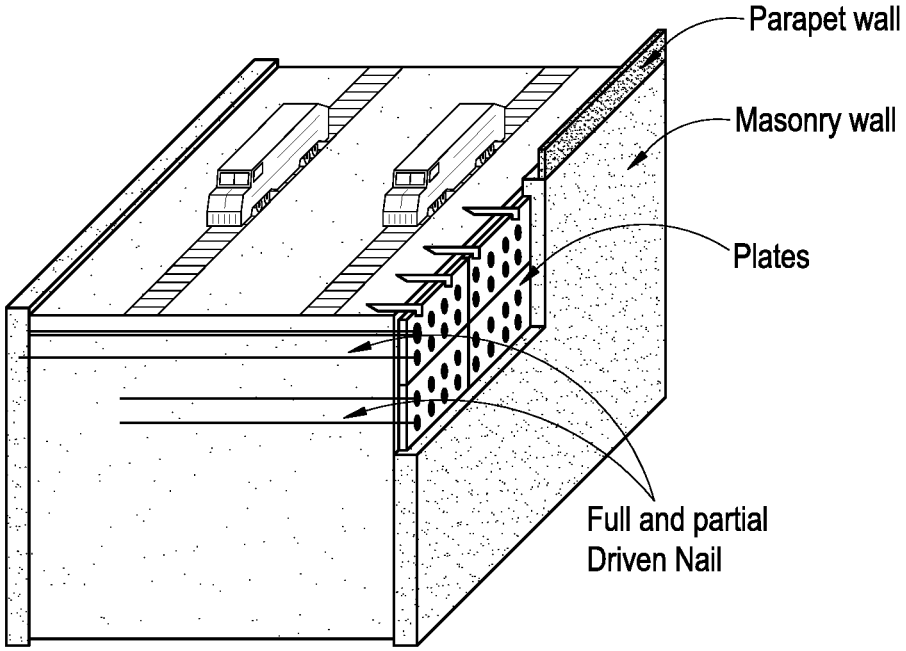
Figure 3F:
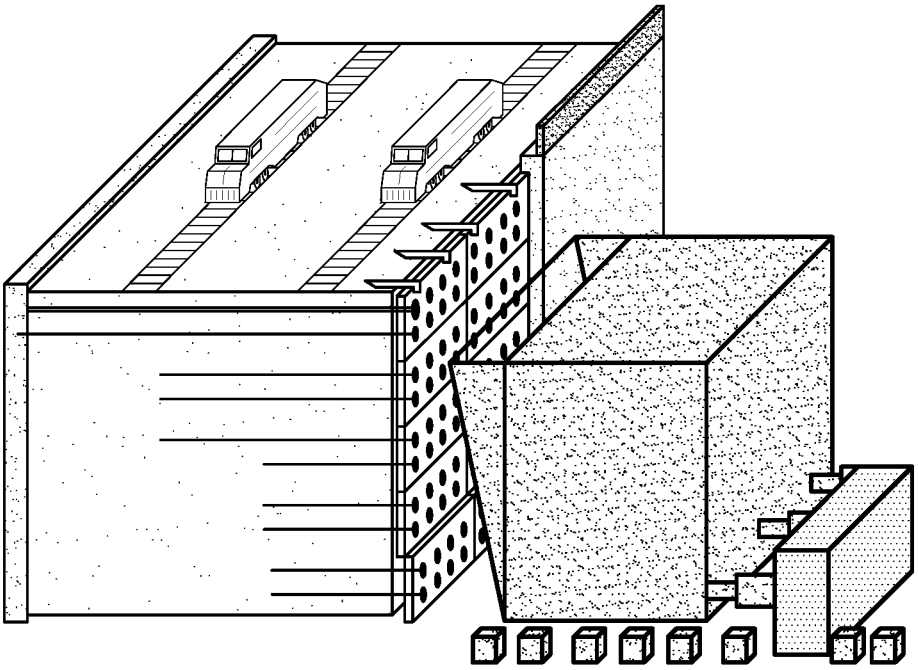
Figure 3G:
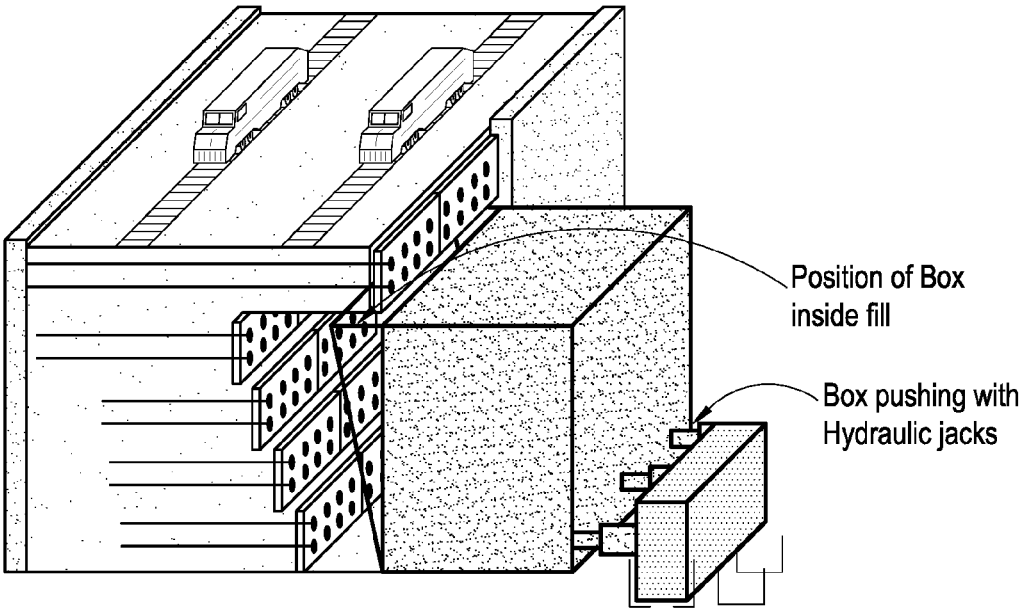
Figure 3H:
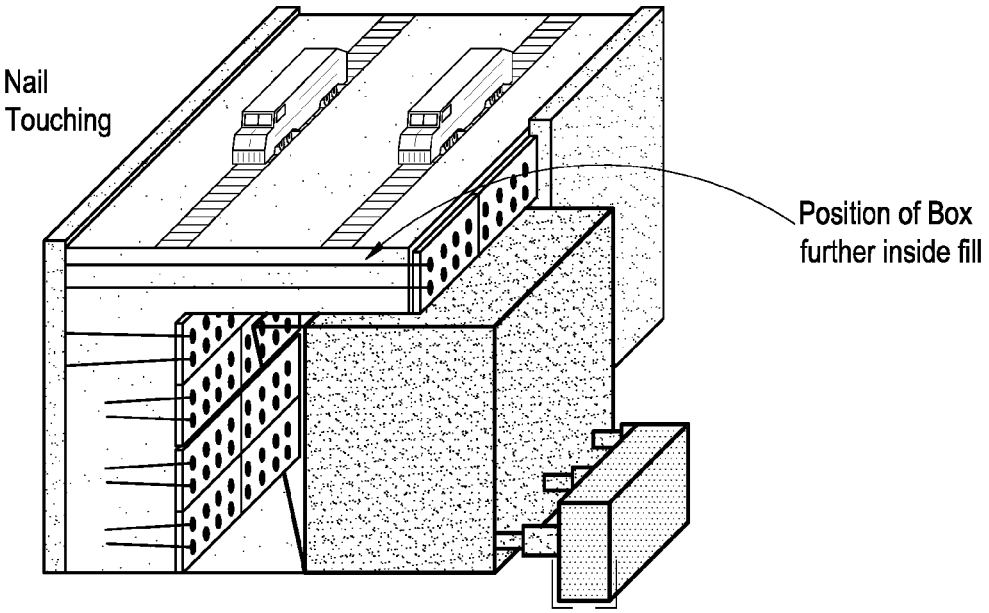
Figure 4:
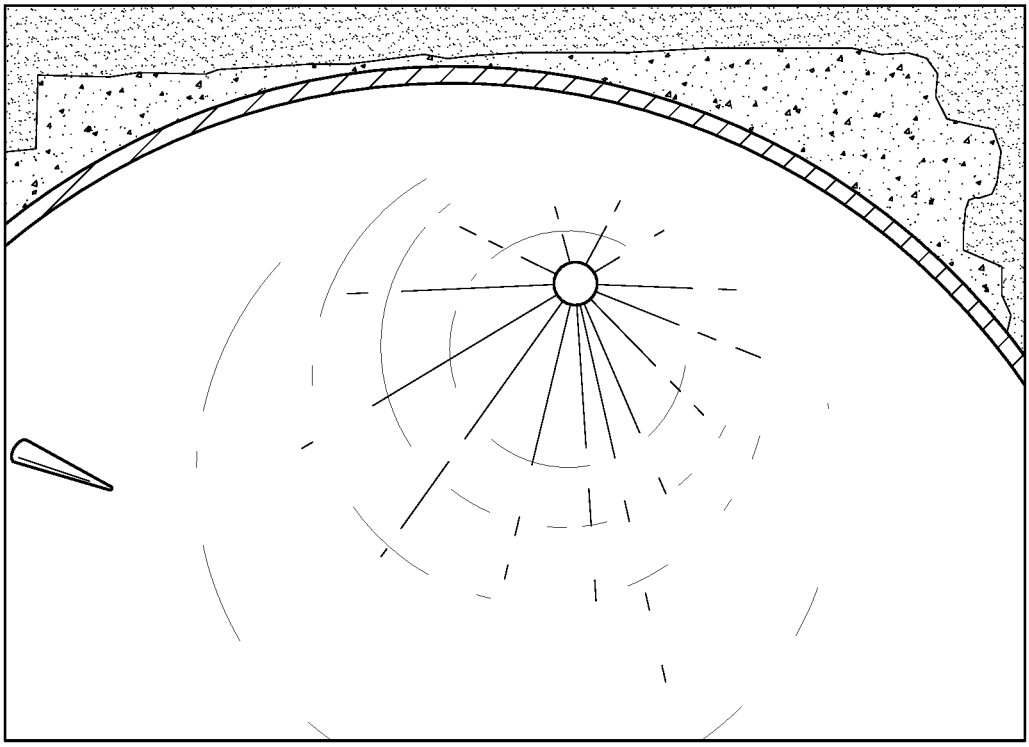

FIG. 1 represents general Lay Out of Box;

FIG. 2*a* Configuration of Nail Design Scheme;

FIG. 2*b* represents embankment with horizontal nails;

FIG. 2*c* represents embankment with horizontal and vertical nails;

FIG. 3(*a*) Sand confined with two retaining walls;

FIG. 3(*b*) Dismantling of parapet wall;

FIG. 3(*c*) Replacement of wall by Nails and plate support;

FIG. 3(*d*) Further Dismantling of wall;

FIG. 3(*e*) Further removal of wall and simultaneous support by Nails and plates;

FIG. 3(*f*) Total removal of retaining wall with Nails and Plates ready for Box pushing;

FIG. 3(*g*) Process showing Nails pushing, backfill removal and Box pushing;

FIG. 3(*h*) Process showing Nails pushing, backfill removal and further Box pushing;

FIG. 4 Pipe pushed below sand embankment using soil nailing technique.

DETAILED DISCRIPTION OF THE INVENTION

In the present invention, the term "De-Stabilisation" means, disturb the existing soil stability by the application of external forces which reduces the shear strength of soil and tends to failure. The main requirement of "De-Stabilisation" is to create space, where the precast box is to be pushed by cutting soil strata below the track which resulted development of instability in the existing soil strata.

The term "Stabilisation" means, the improvement of the engineering properties of the soil either by the addition of some admixture or by soil reinforcement. In the present invention soil reinforcement using Soil Nailing Technique has been used, which increases the shear strength of the soil mass. This technique results in the considerable increase in the frictional resistance of soil, leading to the improved shear strength and load carrying capacity of the soil mass.

Present invention provides stepwise repeated de-stabilisation and stabilisation of highly collapsible soil mass by 'soil nailing technique' used for construction of underpass through Road or Rail embankment confined with or without Retaining walls.

The various options are involved for considering different type of problems, in first case, Railway embankment is constructed by using two retaining walls sandy soil is used as a backfilled material. The underpass is to be constructed by using precast boxes which is to be pushed through these retaining walls with jacking technique. The most typical problem is de-stabilization of backfilled compacted sand by dismantling of retaining walls for creating a space for pushing of box and again stabilisation of sand inside and surrounding to the box.

An innovative technique is investigated for this kind of problem and also same can be used for similar kind of projects of de-stabilisation and stabilisation of soil for underpass construction in all kind of soils.

Stepwise procedure involved in the de-stabilisation and stabilisation of embankment Sandy soil confined with Retaining walls is as follow:

- Geotechnical investigation of site is to be carried out where the underpass is to be constructed.
- Evaluate index and engineering properties of soil up to 1.5 times of the B. The total depth of investigation (H+1.5B), where, B and H are the width and depth of foundation/Box.
- Compute the safe bearing capacity of soil at foundation level.
- Analyses of vertical cut slopes and evaluate Factor of Safety (FOS) for stability of slope;
- If, required FOS of cut slope does not meet the requirement of the project then adopt any ground improvement technique. Soil Nailing has proved a viable solution for De-Stabilisation and Stabilisation of soil for such kind of projects.
- Design the soil Nailing Technique with respect to soil parameters.
- To check the efficacy of Nails, initial field pull out test be conducted and it is mandatory also. Prior to execution of nails system, actual design can be changed according to friction factor obtained from Pull out test, if required.
- The most effective dia 25 mm to 32 mm and length 0.7H of the driven nails.
- If the loading intensity is very high above the box, pull out test on Grouted Nails be conducted the most effective size of Grouted Nail using for steel (d=25 mm), hole dia (4d=100 mm). The ratio is to be maintained "d" and '4d' for nail and hole dia respectively.
- After having friction factor of nail, the complete nails system can be designed with the above said dia range of nails or by using available software like; GEO4.
- The work of Soil Nailing be started from the top of the retaining wall and gradually proceed towards bottom of the retaining wall.
- The position of the box is to be marked on the face of the retaining wall.
- Due to inherent properties of sand, the vertical face will be stable up to 40-50 cm in height.
- The retaining wall is to be dismantled up to 40-50 cm in height.
- To provide a temporary support (shuttering Plate-3 mm thick) to the vertical face after the dismantling of retaining wall. A designed nail dia (+5 mm) and spacing is to be drilled in plate to facilitate the driving of Nails directly through these designed holes.
- The pointed shoes of the nails are to fabricated, which will be ease in the pushing of the Nail. The driven Nail of 25 mm dia of having 3 m length can be easily pushed manually
- Temporary support to protect the surface erosion, shuttering plate of central hole of designed spacing can be used.
- The suitable scaffolding arrangement is to be made simultaneously for soil nailing
- Adequate numbers of drilling machines are to be deployed for installation of Nails as per the site conditions.
- The parapet wall face of the retaining wall is removed till the soil strata appears and immediately pre decided position of hole in the shuttering plate fabricated with 3 mm steel plate be paced to protect the surface erosion.
- Now the ballast/soil in the dismantled portion be graded/swiped, to make the slope 2.0(H):1.0(V) so as to retain the soil and ballast at its position. The first row of grouted nails be installed as this juncture. The process is to be repeated till the required rows of grouted nails are inserted as per design system of Nails.
- The retaining wall is further dismantled, the shuttering plates with pre drilled position of nails be placed for temporary protections of surface erosion.
- The suitable size of the plate can be fixed by as per the spacing and height of cut slope. (One plate should cover minimum two rows and two columns of designed nails).
- This process will be continued till all the rows of driven nail shown in the design scheme are inserted.
- It should be ensured that all the driven nails should be have an extra length of at least 40 cm outside the shuttering plate.
- By following the above said now, the complete retaining wall is now converted into soil Nailed wall.
- It may be ensured that no disruption of train movement should be there during this entire process of nail driving and wall dismantling.
- The box is to be brought very close to the Soil Nailed wall face.
- The anchor system is to be left without any disturbance for minimum eight hours so that required friction on nails is mobilised.
- After eight hours, the top shuttering plates (one row) be loosened and soil behind that plate up to a depth of 30 cm to be excavated/removed. The excavation of soil and removal of the excavated soil will be done subsequently. The excavated soil will be removed by manually or mechanical arrangement.

This procedure of loosening of plate, excavation of soil, removal of soil, further pushing of same Nail into the soil mass and again tightening of shuttering plate with the nail be followed till the entire rows of the nails are covered.

Excavation of the soil face is to be undertaken in such a manner, that the excavated face should have the same slope of the cutting blade (fitted with the box).

It should be ensured that the loosed shuttering plates may be immediately tightened at new position towards the soil mass, so that it supports the new soil face.

All the above said procedure be repeated for each subsequent pushing of box.

As per the optimised design, Nails are designed in varying length.

In order to create the space for box pushing, the nails are to be pushed in subsequent stages, a stage will come when the one first/pointed end of the nails will touch with other end of retaining wall. In such case, the required pushing length (i.e. 30 cm approx) of the nail to be cut from (0.7H initial length) to create the space for box pushing.

The cutting of Nail length in subsequent stages lead to shortage of designed Nail length resulted the instability to the cut slope.

In order to increase the stability of cut slope, extra vertical nails of same dia up to the bottom of slope (minimum=0.9H) be placed from vertical.

The vertical Nails are to be placed prior to 50% of length of pushing.

The complete schematic procedures for wall dismantling, placing of shuttering plate, driving of nails, excavations of soil, pushing of box are shown in FIGS. 3(*a*) to 3(*h*).

In case of no retaining walls, Nails are directly placed in the collapsible soil and improve the stability of slope. All the above said steps be strictly followed except dismantling of walls.

TABLE 1

CHECK FOR BEARING CAPACITY OF NAILS
Verification of nails bearing capacity

| Nail No. | Inserted [kN] | B.cap. [kN] | Nail force Computed B.cap. [kN] |
|---|---|---|---|
| 1 | 117.00 | 0.00 | 8.25 |
| 2 | 121.50 | 0.00 | 17.13 |
| 3 | 56.00 | 0.74 | 8.05 |
| 4 | 57.20 | 2.43 | 10.16 |
| 5 | 57.60 | 3.02 | 12.67 |
| 6 | 57.60 | 3.61 | 15.59 |
| 7 | 32.00 | 3.59 | 10.29 |
| 8 | 32.00 | 4.16 | 11.91 |
| 9 | 32.00 | 3.54 | 13.53 |
| 10 | 24.00 | 4.69 | 10.30 |
| 11 | 24.00 | 4.66 | 11.72 |
| 12 | 24.00 | 6.71 | 13.14 |
| 13 | 24.00 | 7.45 | 14.57 |
| 14 | 24.00 | 5.12 | 15.99 |
| 15 | 24.00 | 5.01 | 17.41 |
| 16 | 24.00 | 5.09 | 18.83 |
| 17 | 24.00 | 5.16 | 20.25 |
| 18 | 24.00 | 5.24 | 21.67 |
| 19 | 24.00 | 5.31 | 23.09 |
| 20 | 24.00 | 5.39 | 24.51 |
| 21 | 24.00 | 5.46 | 25.93 |
| 22 | 24.00 | 5.54 | 27.35 |

TABLE 1-continued

CHECK FOR BEARING CAPACITY OF NAILS
Verification of nails bearing capacity

| Nail No. | Inserted [kN] | B.cap. [kN] | Nail force Computed B.cap. [kN] |
|---|---|---|---|
| 23 | 24.00 | 4.20 | 28.42 |
| 24 | 24.00 | 4.24 | 29.49 |

Computed bearing capacity is determined for driven (not grouted) nails. The real bearing capacity is significantly higher and the bearing capacity of nails is acceptable.

TABLE 2

CHECK FOR EXTERNAL STABILITY

Check for overturning stability:

Resisting moment Mres = 0.9 * 8790.37 = 7911.34 kNm/m
Overturning moment Movr = 466.96 kNm/m
Wall for overturning is ACCEPTABLE
Check for slip:

Resisting lateral force Hres = 0.9 * 581.44 = 523.29 kN/m
Active lateral force Hact = 163.63 kN/m
Wall for slip is ACCEPTABLE
Forces acting at the center of the footing bottom:

Overall moment M = −3607.29 kN/m
Normal force N = 1173.17 kN/m
Shear force Q = 163.63 kN/m
Bearing capacity of foundation soil check:

Eccentricity of normal force e = 0.00 cm
Maximum allowable eccentricity e, allow = 265.32 cm
Eccentricity of the normal force is ACCEPTABLE
Stress at the footing bottom Sigma = 145.92 kPa
Bearing capacity of foundation soil Rd = 300.00 kPa
Bearing capacity of foundation soil is ACCEPTABLE

TABLE 3

CHECK FOR INTERNAL STABILITY
SLIP SURFACE AFTER OPTIMIZATION

Angle of slip surface = 11.00 degr.
Origin of slip surface = 8.50 m
Gravitational force = 830.61 kN/m
Overall force transmitted by nails behind sl. surf. = 140.08 kN/m
Driving forces on slip surface (grav. force) = 158.49 kN/m
Driving forces on slip surface (pressure) = 291.62 kN/m
Resiting forces on slip surface (soil) = 466.77 kN/m
Resisting forces on slip surface (nails) = 137.50 kN/m
Stability factor Fh/Fm = 1.34 > 1.25
Stability of slip surface is acceptable.

Stability Analysis of End Portion: Stage when Nails Cannot be Driven Further (4 m from Exit End+Retaining Wall Thickness from Far End).

It was found during the time of design that the embankment is unstable even with nails when the box is reached at a location, where the width of fill is less than 4.5 m as at this stage the horizontal nails were not able to provide sufficient stability. In such cases, the lengths of the nails are keep on reducing, a unstable condition is creating at or 4.5 m before the exit end. In view of the instability of the embankment at this end, vertical nails were designed. In order to increase the factor of safety pressure grouting with cement is also suggested. The factors of safety for different condition are indicated in tables given on next page.

TABLE 4

| STABILITY ANALYSIS OF END PORTION | | |
|---|---|---|
| | F.O.S of an embankment with | |
| Surcharge (kN/m) | Horizontal nails | Horizontal & Vertical nails |
| 80 | 1.02 | 1.16 |
| 100 | 0.97 | 1.10 |
| 125 | 0.92 | 1.04 |

TABLE 5

| SPACING OF VERTICAL NAILS | | |
|---|---|---|
| Distance from horizontal (m) | Horizontal Spacing of vertical Nails (m) | Length (m) |
| 0.3 | 0.5 | 7.0 |
| 1.3 | 0.5 | 7.0 |
| 2.3 | 0.5 | 7.0 |
| 3.3 | 0.5 | 7.0 |

EXAMPLES

Following examples are given by way of illustration and therefore should not, be construed to limit the scope of the invention.

Example 1

Design of Soil Nailing for Stabilisation of Vertical Cut Slopes for Construction of Road Under the Approach Embankment of Bridge by Box Pushing Technique at West End Approach of Old Yamuna Bridge No. 249, Delhi Shahadra Section During the recently concluded Commonwealth games, it was proposed to construct a bye pass road from ISBT (Kashmeri Gate-Delhi) to ITO to decongest the existing ring road traffic, which traverses through the Yamuna Bazar, Shantivan and Rajghat to connect ITO Bridge. In order to construct the proposed bye-pass, named as "Salimgarh Fort to Velodrome Road", it was necessary to cross the existing Shahadra-Old Delhi railway line, which was constructed on an embankment about 15 m high adjacent to old Yamuna Bridge popularly known in Delhi as Steel Bridge (Loha Pul). The upper portion of the steel bridge is being used for the rail movement and lower one is being used by road traffic. This railway bridge is considered as life line of Delhi as more than 350 trains cross this bridge, which include Rajdhani, Shatabdi and several express and goods train. The railway bridge along with the approach embankment was constructed about 135 years ago by British Engineers. During the preliminary investigation carried out by the railway authorities, it was found that the high approach embankment is made up of pure sand and is confined between the two stone masonry retaining walls.

In order to cross this railway track, there were two options; either to construct a flyover over the existing railway line or to construct an underpass below the existing railway line. The construction of a flyover over the existing railway line was ruled out by the hard pressed authorities i.e., Delhi PWD and Indian Railway due to the exorbitant cost, problems of land acquisition and time constraint at the time of Commonwealth Games.

It was therefore decided to construct an underpass. It was further decided that technique of "Box Pushing" which is now gaining momentum in various civil engineering projects dealing with under ground projects be adopted for the construction of an underpass.

Normally in box pushing technique, the precast box is pushed below the existing ground by making vertical cuts in the ground, and subsequently the box is pushed in the soil using hydraulic Jacks and simultaneously removing the soil inside the box. The precast boxes are fitted with cutting shoes of the required size all along the face of the box. These cutting shoes facilitate the driving of box into the soil mass. This technique is quite successful in soils having cohesion as such soils can stand in vertical position without external support for considerable time.

In view of the extensive volume of traffic likely to use the bye pass, it was proposed to provide three precast RCC boxes below the existing railway track to facilitate free flow of traffic. The dimensions of two boxes as per the available space and geometry were worked out to be 12.1 m×7.35 m each and the remaining one has a dimension of 10.6 m×5.6 m.

To accomplish this task, it was required to remove the retaining wall made up of stone masonry on both sides of the embankment to facilitate the box pushing. However, the biggest challenge in this project was to retain the dry sandy strata in vertical position without collapse under the dynamic loads caused by moving trains, after the demolition of the retaining wall, so that the box can be gradually pushed in the sand. The additional challenge was to keep the train movement operational without interruption during the period of box pushing. The railway authorities and contracting agency had no clue to carry out the project work under such a typical situation. The railway interacted with several agencies to suggest a suitable methodology to carry out the work, but most of them have indicated that it is not feasible. The literature survey on the topic has also not revealed that work of such a nature is being carried out anywhere in the world.

To carry out this task, detailed field and laboratory investigations were carried out and all the relevant data pertaining to the project was collected. Based on our previous experience of handling projects of underground construction and the problems of slope stability in hilly terrain in landslides prone areas, it was decided after lot of deliberations with railway authorities to adopt 'Soil Nailing Technique' for the stabilisation of vertical cut slope in sandy strata to facilitate the box pushing through sand, while maintaining the movement of train without any interruption.

Under this project, the soil nailing technique is conceptualised for stabilising pure sandy soil of collapsible nature under heavy dynamic loading. The concept was initially tested in a small scale laboratory model studies. Based on the observations a design was developed for a large scale live project with heavy dynamic loads with the help of nails and supportive plates. The bending and shear stresses were checked at different locations in the entire soil mass to prevent failure due to shear and surface erosion.

Though it was quite difficult to replicate the field conditions in the model test, nevertheless, the model studies provided a great insight to understand the behaviour of mass movement of sandy soil under heavy and dynamic loads with and without soil nailing. On the basis of the model studies, strategy for design and construction methodology of the project was formulated. Complete design and construction methodology for the proposed technique was provided by CRRI. The technique helped in successfully pushing the three boxes and creating an underpass in a record period of time without any kind of problem and this has resulted to open the bye-pass road much before the commencement of the commonwealth games.

Field Investigations, Design and Construction Methodology

Since the bridge and the approach embankment and other adjoining structures were constructed about 135 years ago, no data related to the wall structure and soil fill behind the retaining wall was available with the site engineers.

In the absence of records, cross-section of retaining wall was explored by adopting GPR technique. The GPR study showed that the retaining walls have a battered face towards earth side having thickness more than 2 m.

The underpass was to be constructed at a location, where rail level was about 9.2 m above the natural ground level and the embankment is contained in between two long rubble stone retaining walls. There were two main lines, i.e., North and South bound tracks and the width between the retaining wall is 15 m.

Backfill material behind the retaining wall from natural ground level up-to the rail bed was uniformly graded fine sand (Cohesion, C=0 and angle of internal friction ø=29$^{o}$). Below the natural ground level, there is conglomerate soil up to 2 m depth and thereafter the strata consist of fine sand up to 6 m depth.

In order to create an underpass, it was decided that Box pushing technique would be adopted.

The estimated pushing length worked to be about 22 m. The precast box segments were required to be pushed in highly unstable cohesion-less strata. Also rubble stone masonry wall on reception and exit ends of the box were required to be dismantled, which would expose unsupported earth face of 8 m height prone to collapse. The cohesion-less soil strata was to be stabilised by adopting suitable technique prior to taking up pushing operation.

After the thorough investigation of the site condition and keeping in view the project requirement, CRRI team proposed the use of soil nailing technique for the stabilisation of sandy soil under the heavy dynamic loads caused by rail movement.

Design for Soil Nailing

The design of soil nail system was carried out using software GEO 4 available at CRRI. which is generally used to evaluate slope stability problems of high embankments. A system of grouted and driven nails was considered in the design. The input parameters considered in the design were "External loading due to railway track including ballast—110 kN/m per track" The detailed results of nailing design is presented in Annexure-I to Annexure-III (as suggested by railway officials), "Geometry of the cut slope" considered and the "back fill soil properties".

In order to carry out the analysis and to design a suitable configuration of nails to be grouted or nailed into the soil mass, so that the entire mass of sand confined between the two retaining walls be maintained in vertical position even after removing the two side walts, it was essential to determine the apparent coefficient of friction (f*) between in-situ soil and nail for design of nail network for the stabilisation of vertical cut. The in-situ pull-out tests were conducted at the site by driving the nails through the thick stone masonry wall. Two different methods of nailing were adopted viz. i) driven nail-32 mm, ii) perforated pipe nail-89 mm dia with perforation of 12 mm @ 50 mm c/c in staggered manner. Six pull out tests were conducted on grouted nails and eight tests were conducted on driven nails at different locations. The results of Pull out test were used in design analysis and computation.

In order to finalise the spacing, length and diameter for driven and anchored nails to keep the soil in vertical position after the removal of wall, a suitable scheme was designed using GEO 4 software. The nailing scheme indicating details of spacing of the nails required for stabilising the cut face at the underpass location is given in Table 1 and configuration of nails is shown in FIG. 2. One row of grouted nails as in the top and 22 rows of driven nails below the grouted nails have been considered. For grouted nails, diameter is taken as 100 mm and length of the nails is kept 15 m shown in FIG. 2. For driven nails, two different diameters of the nails were considered—32 mm and 28 mm. The inclination of the nails has been considered at zero degree with respect to horizontal (i.e., Nails to be driven horizontally) and nail heads are to be anchored with plate. Length of the driven nails varied according to their location.

Based on the above Nailing scheme, the stability of vertical sand reinforced with nails was checked for both External and Internal Stability. The computer output and the relevant analysis for verification of nail bearing capacity (pull out strength), verification of entire wall (global stability) and stability of slip surface after optimisation of iterations.

TABLE 1

Proposed Design Scheme of Soil nailing for Box Pushing

| S. No | Dia. Of Nail (mm) | Type of nail | Depth from rail top (m) | Spacing (m) Verical | Spacing (m) Horizontal | Effective Length of Nail (m) | Original length of nail |
|---|---|---|---|---|---|---|---|
| 1 | 100** | Grouted | 1.3 | — | 0.5 | 15 | 15 |
| 2 | 32* | Driven | 1.55 | 0.3 | 0.4 | 15 | 15 |
| 3 | 32* | nails | 1.75 | 0.2 | 0.3 | 15 | 15 |
| 4 | 32* | | 2 | 0.25 | 0.3 | 15 | 15 |
| 5 | 32* | | 2.3 | 0.3 | 0.3 | 15 | 15 |
| 6 | 32 | | 2.6 | 0.3 | 0.3 | 8 | 8.3 |
| 7 | 32 | | 2.9 | 0.3 | 0.3 | 8 | 8.3 |
| 8 | 32 | | 3.2 | 0.3 | 0.3 | 8 | 8.3 |
| 9 | 28 | | 3.6 | 0.4 | 0.3 | 6 | 6.3 |
| 10 | 28 | | 4 | 0.4 | 0.3 | 6 | 6.3 |
| 11 | 28 | | 4.4 | 0.4 | 0.3 | 6 | 6.3 |
| 12 | 28 | | 4.8 | 0.4 | 0.3 | 6 | 6.3 |
| 13 | 28 | | 5.2 | 0.4 | 0.3 | 6 | 6.3 |
| 14 | 28 | | 5.6 | 0.4 | 0.3 | 6 | 6.3 |
| 15 | 28 | | 6 | 0.4 | 0.3 | 6 | 6.3 |
| 16 | 28 | | 6.4 | 0.4 | 0.3 | 6 | 6.3 |
| 17 | 28 | | 6.8 | 0.4 | 0.3 | 6 | 6.3 |
| 18 | 28 | | 7.2 | 0.4 | 0.3 | 6 | 6.3 |
| 19 | 28 | | 7.6 | 0.4 | 0.3 | 6 | 6.3 |
| 20 | 28 | | 8 | 0.4 | 0.3 | 6 | 6.3 |
| 21 | 28 | | 8.4 | 0.4 | 0.3 | 6 | 6.3 |
| 22 | 28 | | 8.7 | 0.3 | 0.3 | 6 | 6.3 |
| 23 | 28 | | 9 | 0.3 | 0.3 | 6 | 6.3 |

**these nails should be grouted/driven up to another side of the retaining wall.

*indicates the nail comes under box top cover. Nails should cut at regular intervals during box pushing. The length of the nails mentioned above is effective lengths. The total length of the nails should be kept 30 cm extra for the movement or driving of nails.

Construction Methodology

In order to push the box below the railway line, it was required to remove the random rubble masonry at the first instance. Since the soil is cohesion less with very little or no shear strength under unconfined state, it was proposed to remove the wall in small segments and simultaneously retain the backfill by inserting nails at suitable space and retaining the face of the unsupported mass with a facia panel. Since the executing agency has no prior experiencing of executing works of such a nature, it was proposed by the railway engineers to push the smaller box first. The step wise procedure for undertaking the work as suggested and followed at site is described below.

General Arrangements

A number of girders were provided below the sleepers at regular intervals. These girders were allowed to rest on one side on the retaining wall/box with pulley arrangement and on the other side on soil/ballast.

The suitable scaffolding arrangement was made simultaneously for soil nailing.

Adequate numbers of drilling machines were deployed for installation of Nails.

Arrangements for Soil Nailing

The work of Soil Nailing started from the top of the retaining wall and gradually proceeded towards bottom of the retaining wall.

The position of the boxes was marked on the face of the retaining wall.

The parapet wall face of the retaining wall was removed till the soil strata appears.

Now the ballast/soil in the dismantled portion was graded/swiped to make the slope 2.0(H):1.0(V) so as to retain the soil and ballast at its position. The first row of grouted nails was installed as this juncture. The process was repeated till the two rows of grouted nails were inserted.

The wall was further dismantled and the nails as shown in the table 1 were inserted. The shuttering plates were also provided on the nail heads to retain the soil temporarily. The size of shuttering plate was approximately 50×50×3 mm.

It may be noted that nails up to the sixth row from top were driven up to the full length i.e., up to 15 m. The next three rows were driven up to 8 m. The nails within or inside the box were initially driven up to only 6 m. The nails were pushed gradually inside the box as the box was advanced slowly with the help of hydraulic jacks fitted behind the box. The aluminium strips were provided at top of the box to minimise the friction between box roof and the soil.

This process continued till all the rows of driven nail shown in the design scheme are inserted.

By following this system, it was possible to retain the entire soil mass with the help of nails and plates. It may be noted that no disruption of train has occurred during this entire process of nail driving and wall dismantling.

After the removal of the entire retaining wall on one side, the box was brought very close to the shuttering plates.

It was ensured that all the driven nails should be having an extra length of at least 40 cm outside the shuttering plate.

The anchor system was left without any disturbance for minimum eight hours so that required friction on nails is mobilised.

After eight hours, the top shuttering plates (one row) were loosened and soil up to a depth of 30 cm was removed. Similarly the plates and soil in the inside portion of box was removed up to the bottom of box. It created a space of approximately 30 cm for the box to be pushed immediately. The procedure of wall dismantling and driving of nails has been depicted schematically with the help of FIGS. 3(*a*) to 3(*h*).

Excavation of the soil face was undertaken in such a manner, that the excavated face is having the same slope of the cutting blade (fitted with the box).

Shuttering plates were immediately tightened after excavation and driving the nails, so that it supports the soil face.

Now the box pushing operation was started and box was pushed for a distance of about 30 cm or less. In this manner, the box was further pushed inside the fill.

This process was continued until the box has been pushed to about 8 m from the exit side retaining wall. When it was not possible to push the nails further inside the soil due to the obstruction caused by the exit side wall, the nails were cut.

The slope studies indicated that in the end portion the soil mass was once again found to be non stable with only horizontal nails and therefore it was decided to go for vertical nails also in the remaining portion.

Vertical driven nails were inserted near the exit side retaining wall as shown in the design (Annexure IV). This work is to be completed at least 20 days before the box reaches to a distance of 8 m from exit side retaining wall.

The driven nails of 15 in length (touched with the other retaining wall) which were covering or in front of the thickness of the box at the top level were trimmed off with gas welding at every 30 cm increments after excavation.

This procedure has helped in taking the box up to the exit side. After reaching the other side of the wall, the other side of the wall was dismantled and box was pushed further. The entire process as described above has facilitated in creating an underpass below the rail embankment. The stepwise procedure as discussed was also followed for the remaining two boxes, which were of larger size and finally an underpass were constructed with a very simple and innovative technology as suggested by CRRI.

Technical Challenges Overcome

The biggest challenge in this project was to suggest and design a system to retain the collapsible sandy strata in vertical position under the dynamic loads caused by moving trains, after the demolition of the retaining wall, so that the box can be gradually pushed inside the sand, to create an underpass.

The additional challenge was to develop a methodology for box pushing, so that the train movement remain operational without interruption during the period of box pushing.

During the entire period of construction, CRRI team remained on site and guided the engineers of the railway and the contractor on day to day basis. Since the work of such a nature was carried out for the first time in the country, minor modifications in the design and construction methodology as per the site conditions were to be made from time to time and the same were duly checked and verified by the CRRI scientists using the available software against all possible mode of failures.

In addition to the above, there were a number of site specific problems during the period of construction; such as convergence of nails at several locations, development of piping phenomenon in sand and collapsing of sand at some locations, which were immediately overcome/tackled due to the vast experience and knowledge of soil mechanics principles of the team of scientists dealing with the project work.

Example 2

Box Pushing Technique with Soil Nailing at Apsara Border (without Retaining Wall)

After the successful completion of box pushing at old Yamuna Bridge, AFCONS (a multinational construction company) on the recommendations of the Northern Railway approached CRRI to give a complete design and construction methodology for creating an underpass below railway line at Apsara border, which is very close to Delhi-Shahibabad border. This project was more challenging than the previous one and here length of underpass was more than the previous one. Here again on the same concept of soil Nailing, CRRI provided a complete design and construction methodology, which was successfully implemented on this project as well. Few photograph of this site are given here.

Example 3

Large Size Water Pipe Line Pushing Below Sand Embankment Near Yamuna Bridge, Delhi This project work was given to CRRI by Larsen and Tubro (L& T). Here again using the technique of soil nailing, a large size of water pipe line was pushed below at 12 m high sand railway embankment retained between two retaining wall. Few photographs of the same are given below.

ADVANTAGES OF THE INVENTION

Installation of Soil Nailing Technique is quite simple and fast.

Length of Nail can be coped/curtailed with site constraints and variations in ground conditions encountered during construction The equipment required for the construction of Soil Nailing is very simple and light.

This technique can be easily be mobilised at cramped and difficult sites

The soil. Nailing techniques performs well even in seismically zones.

There could be time and cost savings about 10 to 30 percent when we compared with other earth retaining techniques.

Soil Nailing Technique requires a very less space to implement.

What is claimed is:

1. A process for making an underpass through a railway track or road without service interruption by stepwise destabilization and stabilization of a collapsible soil mass by a soil nailing technique, the process comprising the steps of:

(i) marking a position of a box on a vertical face of a first retaining wall or an embankment;

(ii) dismantling the retaining wall above the marked position of the box and providing temporary support by shuttering plates having holes for pre-decided positions of nails to be driven in the vertical face;

(iii) nailing the soil mass by using grouted nails and driven nails above the marked position of the box;

(iv) again dismantling the first retaining wall, placing the shuttering plates with pre-drilled positions of nails and inserting only the driven nails from the top to the bottom of a box pushing area;

(v) leaving a complete nail system for a period in the range of 8 to 12 hrs to mobilize the friction of the nails;

(vi) bringing the box close to the soil-nailed, wall face;

(vii) loosening one top row of shuttering plates, and excavating the soil to a 30 to 40 cm depth;

(viii) repeating step (vii) until the entire rows of the nails are covered for a 30 to 40 cm depth followed by pushing the box into the excavated area of 30 to 40 cm depth;

(ix) pushing the nails into the soil mass and again tightening of the shuttering plates;

(x) repeating steps (vii) to (ix) until 50% of the box pushing length;

(xi) cutting the nails in the range of 25 to 35 cm to create a space for box pushing wherein first/pointed ends of the nails will touch a second retaining wall, followed by placing vertical nails in order to increase the stability of the cut slope; and (xii) again repeating steps (vii) to (ix) until complete insertion of the box for making an underpass.

2. The process as claimed in claim 1, wherein a thickness of the shuttering plate used is in the range of 3 to 5 mm.

3. The process as claimed in claim 1, wherein a length of the grouted nail and driven nails in step (iii) is equal to the length of the underpass.

4. The process as claimed in claim 1, wherein a diameter of the grouted nail used is in the range of 90 to 110 mm.

5. The process as claimed in claim 1, wherein a diameter of the driven nail used is in the range of 25 to 32 mm.

6. The process as claimed in claim 1, wherein a length of the driven nail used in steps (iv) to (xii) is optimized with height of the vertical cut height in 0.7 H wherein H is the height of vertical cut slope.

7. The process as claimed in claim 1, wherein it is ensured that all the driven nails have an extra length of at least 40 cm outside the shuttering plate.

* * * * *